US008142069B2

(12) United States Patent
Müller et al.

(10) Patent No.: US 8,142,069 B2
(45) Date of Patent: Mar. 27, 2012

(54) DEVICE FOR SECURING A BACK COVER TO THE MIDDLE PART OF A WATCH

(75) Inventors: Jacques Müller, Reconvilier (CH); Clément Meyrat, Le Landeron (CH); David Apotheloz, Corcelles (CH); Luciano Eleuterio, Corgémont (CH); Bertrand Carrard, Bassecourt (CH); Rocco Catanese, Bienne (CH); Domenico Leo, Reconviller (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 12/065,961

(22) PCT Filed: Sep. 4, 2006

(86) PCT No.: PCT/EP2006/008596

§ 371 (c)(1),
(2), (4) Date: Mar. 6, 2008

(87) PCT Pub. No.: WO2007/028554

PCT Pub. Date: Mar. 15, 2007

(65) Prior Publication Data

US 2008/0225650 A1 Sep. 18, 2008

(30) Foreign Application Priority Data

Sep. 6, 2005 (EP) ..... 05019294

(51) Int. Cl.
*G04B 37/00* (2006.01)

(52) U.S. Cl. ..... 368/310; 368/309; 368/281

(58) Field of Classification Search ..... 368/309, 368/310

See application file for complete search history.

(56) References Cited

U.S. PATENT DOCUMENTS

| | | | | |
|---|---|---|---|---|
| 4,626,107 | A * | 12/1986 | Nishikawa et al. | 368/276 |
| 6,094,403 | A * | 7/2000 | Tran et al. | 368/10 |
| 6,761,479 | B2 * | 7/2004 | Meyrat et al. | 368/281 |

FOREIGN PATENT DOCUMENTS

| | | |
|---|---|---|
| CH | 333 257 | 11/1958 |
| CH | 10 950/60 | 12/1962 |
| CH | 632 375 | 10/1982 |
| DE | 22 23 007 | 12/1972 |
| EP | 1 278 108 A1 | 1/2003 |

OTHER PUBLICATIONS

International Search Report issued in corresponding application No. PCT/EP2006/008596, completed Feb. 21, 2007 and mailed Mar. 1, 2007.

English translation of the European Search Report for application No. 01 20 6261.

* cited by examiner

*Primary Examiner* — Renee S Luebke
*Assistant Examiner* — Jason Collins
(74) *Attorney, Agent, or Firm* — Griffin & Szipl, P.C.

(57) ABSTRACT

The invention includes a device for securing a back cover on a middle part of a watchcase, characterized in that it includes an intermediate element to which the back cover is connected, the intermediate element being screwed onto the middle part of the watch, an element arranged to allow the back cover to drive the intermediate element in rotation until the latter reaches a locked position on the middle part, the back cover also being pivotable relative to the intermediate element without the latter being unscrewed for alignment with the 12 o'clock-6 o'clock axis of the watch.

27 Claims, 4 Drawing Sheets

DEVICE FOR SECURING A BACK COVER TO THE MIDDLE PART OF A WATCH

This is a National Phase Application in the United States of International Patent Application No. PCT/EP2006/008596 filed Sep. 4, 2006, which claims priority on European Patent Application No. 05019294.7, filed Sep. 6, 2005. The entire disclosures of the above patent applications are hereby incorporated by reference.

FIELD OF THE INVENTION

The present invention concerns a device for securing a back cover to the middle part of a watch. More specifically, the invention concerns a device of this type that can align the back cover relative to the 12 o'clock-6 o'clock axis of the watch.

BACKGROUND OF THE INVENTION

It frequently happens that, when a back cover of a watchcase is screwed onto the middle part thereof, one realises that, when the back cover is completely screwed in, the markings or decorative patterns, which may for example, have been stamped or etched on the face of the back cover located on the side of the watch wearer's wrist, are not suitably aligned relative to the vertical 12 o'clock-6 o'clock axis of the watch, which, of course, is detrimental to the aesthetic appearance of the watch.

While this defect in appearance may be tolerated for cheap watches, it constitutes a very inconvenient drawback for more expensive watches.

In order to overcome this drawback, the only solution known in the past consists in matching a back cover with a determined watchcase during machining, in order to ensure that once completely screwed in, the back cover is perfectly aligned with the 12 o'clock-6 o'clock axis of the watch. This solution was, however, unsatisfactory since problems were likely to occur if the original back cover of the watch was ever lost or ruined and had to be replaced by another back cover, since one could only be certain that the back cover was properly aligned with the vertical 12 o'clock-6 o'clock axis once it was screwed onto the middle part.

The Applicant of the present Application in EP Patent Application No. 01203261.1 proposed a first solution to this problem. EP-A-1278108, which disclosed a device for securing a back cover onto the middle part of a watchcase, the back cover having an external peripheral threading. This device includes an intermediate assembly including a resilient locking element and a metal element concentric to the resilient locking element, this intermediate assembly being forcibly engaged in the bottom part of the middle part of the watch and the back cover being screwed onto the metal element, such that, when the back cover is completely screwed onto the metal element, the metal element can be pivoted by sliding over the resilient locking element as far as a stop point from which the resilient locking element can pivot in turn by sliding over the middle part of the watch, which adjusts the alignment of the back cover relative to the vertical 12 o'clock-6 o'clock axis of the watch.

The solution briefly described above has the merit of providing a first response to the problem of aligning the back cover of a watchcase relative to the 12 o'clock-6 o'clock axis of the latter. In particular, it ensures that the back cover will always be suitably aligned independently of the machining characteristics of the back cover and the middle part. However, this solution implements a large number of parts and requires the use of a pin driven into the middle part and forming a stop member, which, one might fear, is not sufficiently resistant.

It is an object of the present invention to overcome the aforementioned drawbacks in addition to others by providing a device for securing a back cover onto the middle part of a watch, which has a limited number of parts and which works reliably.

SUMMARY OF THE INVENTION

The present invention therefore concerns a device for securing a back cover onto the middle part of a watch, characterized in that it includes an intermediate element to which the back cover is connected, this intermediate element being screwed onto the middle part of the watch, means being provided to allow the back cover to drive the intermediate element in rotation until the latter reaches a locked position on the middle part, the back cover being further capable of being pivoted relative to the intermediate element without the latter being unscrewed in order to be aligned with the 12 o'clock-6 o'clock axis of the watch.

Owing to these features, the present invention provides a device whose small number of parts makes it easy to assemble and reliable in operation. After the intermediate element has been fully screwed into the middle part of the watch, the alignment of the back cover can be adjusted relative to the 12 o'clock-6 o'clock axis of the watch without the intermediate element being unscrewed, which makes the securing device according to the invention impossible to lose. Moreover, the torque to be exerted in order to pivot the back cover of the watch is much greater than the torque that could be exerted by hand, such that the alignment of the back cover cannot be inadvertently modified. It will be noted that the friction torque can be adjusted as desired depending upon the type of construction envisaged.

According to another feature of the invention, the back cover includes an oblong groove in the arc of a circle, in which a drive piece is housed, which is free to move therein and which cooperates with a stop member provided on the intermediate element to drive the latter in rotation until it reaches a locking position on the middle part.

The driven piece and the stop member provided on the intermediate element are extremely resistant, such that there is no risk of this part or stop member deteriorating.

In view of the above general comments regarding the present invention, the present invention, in accordance with a first illustrative embodiment, pertains to a device for securing a back cover (1) onto a middle part (12) of a watchcase, characterized in that it includes an intermediate element (10) to which the back cover (1) is connected, wherein the intermediate element (10) is screwed onto the middle part (12) of the watch, and means are provided to allow the back cover (1) to drive the intermediate element (10) in rotation until the latter reaches a locked position on the middle part (12), and the back cover (1) also is able to be pivoted relative to the intermediate element (10) without the latter being unscrewed for alignment with the 12 o'clock-6 o'clock axis of the watch. In accordance with a second illustrative embodiment of the present invention, the first embodiment is characterized in that, in order to be aligned, the back cover (1) is pivoted in the opposite direction to the direction in which the intermediate element (10) is screwed in. In accordance with a third illustrative embodiment of the present invention, the first embodiment and the second embodiment are modified so that the intermediate element (10) is arranged concentrically around the back cover (1). In accordance with a fourth illustrative embodiment of the present invention, the third embodiment is further modified so that the external periphery of the intermediate element (10) has a thread (36) via which the element is screwed onto the middle part (12) of the watch, which includes for such purpose a complementary thread (38) on the inner periphery thereof.

In accordance with a fifth illustrative embodiment of the present invention, the first embodiment, the second embodiment, the third embodiment, and the fourth embodiment are further modified so that the back cover (1) includes an oblong recess (2) in the shape of an arc of a circle, which houses a drive piece (6), which is free to move therein and which cooperates with a stop member (34) provided on the intermediate element (10) for driving the latter in rotation until the element reaches a locked position on the middle part (12). In accordance with a sixth illustrative embodiment of the present invention, the fifth embodiment is further modified so that the sum of the lengths of the drive piece (6) and the stop member (34) is less than the length of the recess (2). In accordance with a seventh illustrative embodiment of the present invention, the fifth embodiment or the sixth embodiment is further modified so that the drive piece (6) is a ball or a key.

In accordance with an eighth illustrative embodiment of the present invention, the first embodiment, the second embodiment, the third embodiment, the fourth embodiment, the fifth embodiment, the sixth embodiment, and the seventh embodiment, are further modified so that the back cover (1) is indissociably connected to the intermediate element (10). In accordance with a ninth illustrative embodiment of the present invention, the eighth embodiment is further modified so that the connecting element (8) between the back cover (1) and intermediate element (10) is a spring element arranged between the back cover and the intermediate element (10). In accordance with a tenth illustrative embodiment of the present invention, the eighth embodiment is further modified so that the spring element is arranged in a groove (30) made in part in the back cover (1) and in part in intermediate element (10). In accordance with an eleventh illustrative embodiment of the present invention, the eighth embodiment, the ninth embodiment and the tenth embodiment, are further modified so that the spring element is a polygonal spring of generally circular shape formed of a series of segments (8'). In accordance with a twelfth illustrative embodiment of the present invention, the eighth embodiment is further modified so that the connecting element between the back cover (1) and the intermediate element (10) is a ring (46) driven between the back cover (1) and the intermediate element (10).

In accordance with a thirteenth illustrative embodiment of the present invention, the first embodiment, the second embodiment, the third embodiment, the fourth embodiment, the fifth embodiment, the sixth embodiment, the seventh embodiment, the eighth embodiment, the ninth embodiment, the tenth embodiment and the twelfth embodiment are further modified so that a sealing gasket (14) is arranged between the back cover (1) and the middle part (12). In accordance with a fourteenth embodiment of the present invention, the thirteenth embodiment is further modified so that the compression rate of the sealing gasket (14) is at least 10%. In accordance with a fifteenth illustrative embodiment of the present invention, the fourteenth embodiment is further modified so that the torque induced by the sealing gasket (14) is sufficient to prevent the back cover being moved out of alignment by hand but less than the tightening torque of the intermediate element (10) on the middle part (12).

BRIEF DESCRIPTION OF THE DRAWINGS

Other features and advantages of the present invention will appear more clearly upon reading the following detailed description of an embodiment of the securing device according to the invention, this example being given purely by way of non-limiting illustration with reference to the annexed drawing, in which.

DETAILED DESCRIPTION OF THE ILLUSTRATIVE EMBODIMENTS

The present invention proceeds from the general inventive idea that consists in providing a device for securing a back cover onto the middle part of a watchcase for mounting the back cover onto the middle part in a perfectly water resistant manner while allowing the back cover to be orientated properly relative to the 12 o'clock-6 o'clock axis of the watch. This securing device further includes a limited number of parts, which makes it easy to assemble and reliable in operation.

Figure 1:
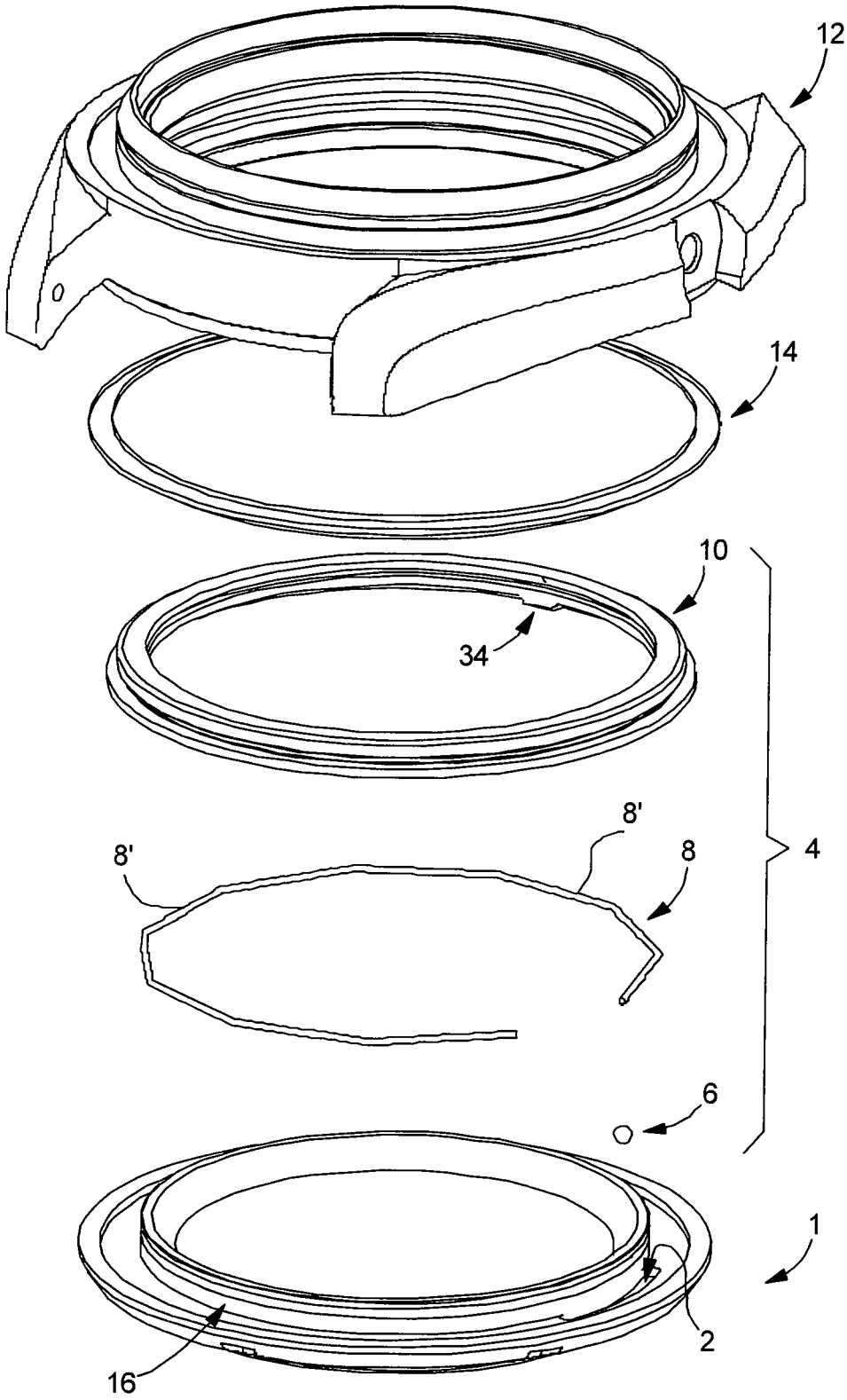
FIG. 1 is an exploded perspective view of the device for securing a back cover to the middle part of a watchcase according to the invention.

FIG. 1 is an exploded perspective view of the various elements of the present invention. An examination of FIG. 1, from bottom to top, shows first of all a back cover 1 of generally circular shape in which an oblong recess in the arc of a circle 2 is arranged. The device for securing back cover 1 according to the invention, actually designated as a whole by the general reference 4, includes a drive piece 6 such as a ball, a key or any other shaped part, a connecting element 8, such as a polygonal shaped spring and an intermediate element 10. As will be seen in the description below, this securing device 4 is used for mounting back cover 1 on the middle part 12 of a watchcase. The assembly shown in FIG. 1 further includes a sealing gasket 14, which ensures the water resistance of the watchcase.

Figure 2:
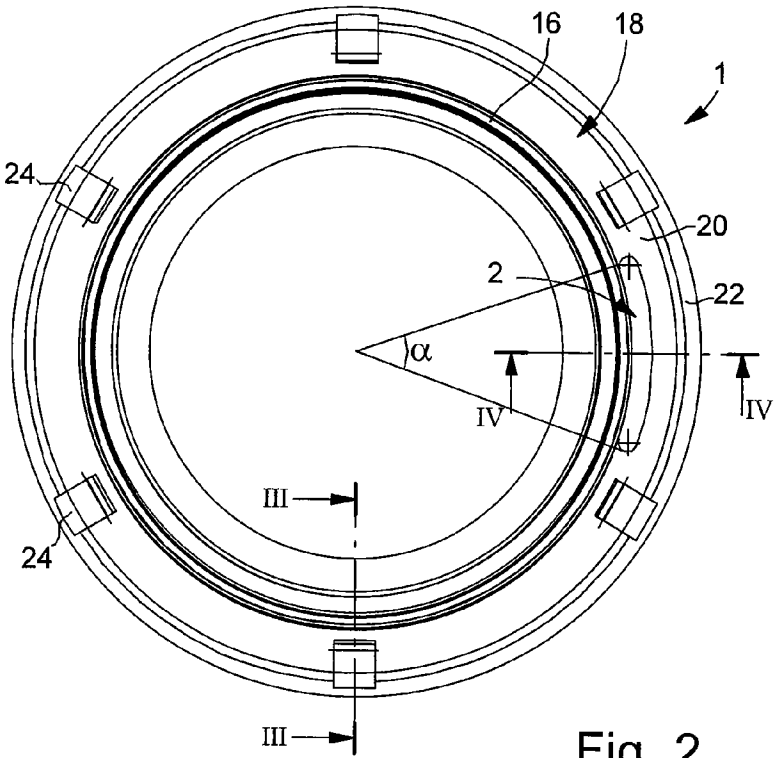
FIG. 2 is a top view of the back cover of the back cover of the watchcase.
Figure 3:
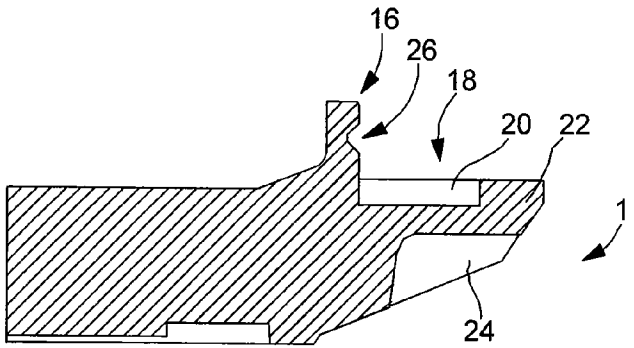
FIG. 3 is a cross-section along the line III-III of the back cover of the watchcase of FIG. 2.
Figure 4:
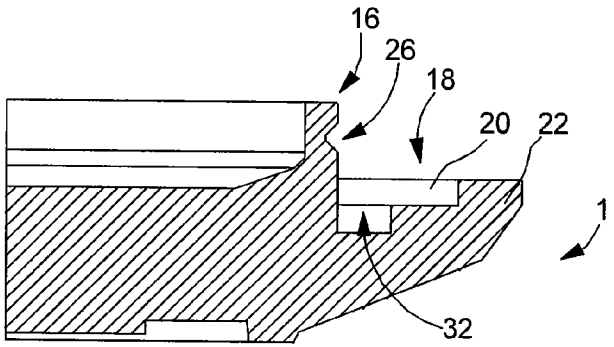
FIG. 4 is a cross-section along the line IV-IV of the back cover of the watchcase of FIG. 2.
Figure 7:
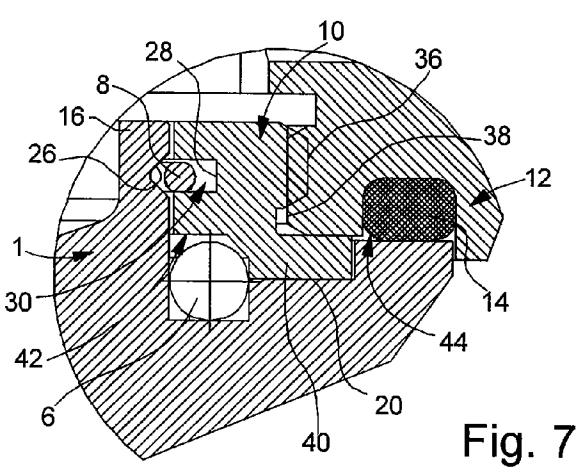
FIG. 7 is a larger scale view of the zone surrounded by a circle in FIG. 6.
Figure 5:
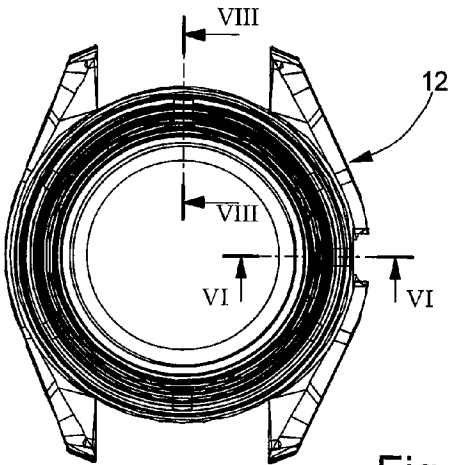
FIG. 5 is a top view of the assembly formed by the middle part and the device securing the back cover according to the invention.
Figure 6:
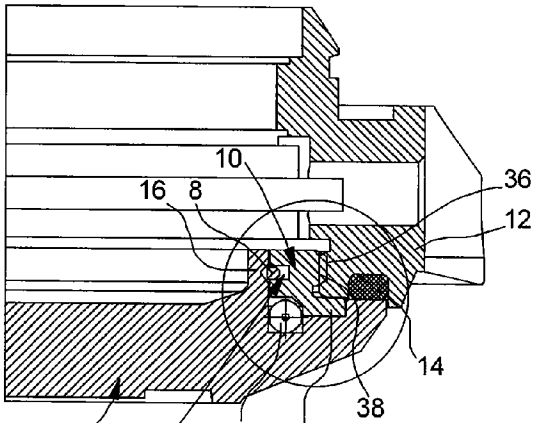
FIG. 6 is a cross-section along the line VI-VI of the assembly shown in FIG. 5.
Figure 8:
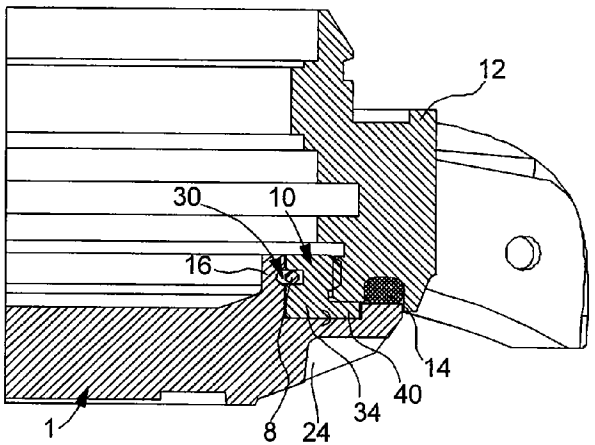
FIG. 8 is a cross-section along the line VIII-VIII of the assembly shown in FIG. 5.

The back cover 1 of the watchcase will be examined in more detail now with reference to FIGS. 2 to 4. As these Figures show, an annular flange 16 stands on back cover 1, of generally circular shape, at a distance from the external periphery of the back cover 1. This annular flange 16 thus delimits an external peripheral surface 18 in which there is arranged a circular groove 20 which extends between the flange 16 and an edge 22. In the bottom surface of back cover 1 facing the wrist of the watch wearer several notches 24 are arranged (six in the example shown in the drawing), which are used for introducing the pegs of a key (not shown) for completely screwing intermediate element 10 into middle part 12 then orientating back cover 1 in a suitable manner relative to the 12 o'clock-6 o'clock axis of the watch. It will be noted that this example is given purely by way of illustration and that the present invention could apply to other types of screwed in back covers such as back covers with flats or without notches known to those skilled in the art. Moreover, a circular undercut 26 is arranged in the external periphery of collar 16 for forming, with a corresponding undercut 28 made in intermediate element 10, an annular groove 30 which will housed connecting element 8, as described in detail below. Finally, an oblong recess 2 in the arc of a circle is made concentrically in circular groove 20. This oblong recess 2, in which drive piece 6 is free to move, forms, in the example shown in the drawing, an angle $\alpha$ of 40°. It goes without saying that this value is given purely by way of illustration and that oblong recess 2 could form an angle as small as 10° or as large as 350°, the only condition governing the dimensions of recess 2 being that it is at least as long as the sum of the lengths (or diameter) of drive piece 6 and a stop member 34 fitted to intermediate element 10. It will be noted that recess 2 could be made at any other place in groove 20, which means that there is not need to provide indexing between back cover 1, intermediate element 10 and middle part 12.

We will now examine in more detail intermediate element 10 and the way it enables back cover 1 to be mounted on middle part 12 of the watchcase with reference to FIGS. 5 to 8. As these Figures show, intermediate element 10 is a circular part on the external periphery of which a thread 36 is machined for cooperating with a corresponding thread 38 provided on the inner periphery of middle part 12. In the inner periphery of intermediate element 10 is undercut 28, which, with undercut 26 made in collar 16, forms the annular groove 30 housing connecting element 8, such as a polygonal shaped spring. This type of spring is also known by the name of bezel spring since it is commonly used for mounting rotating watch bezels. At its base, intermediate part 10 has a circular heel 40, which is housed in groove 20 of back cover 1. Intermediate part 10 is thus guided and held in place radially by annular collar 16 against which it abuts via the external periphery of heel 40. Connecting element 8 axially holds back cover 1 and intermediate element 10 as described in detail below. Moreover, vertical to circular groove 20 of back cover 1, intermediate element 10 has a recess 42, which extends over practically the entire circumference of the intermediate element 10 and which will allow drive part 6 to move. The perimeter of recess 42 is interrupted at one point by stop member 34, which projects into the back cover of circular groove 20. Finally, sealing gasket 14 is arranged between back cover 1 and middle part 12. It is housed in a circular groove 44 made at the base of middle part 12 and abuts on edge 22.

Hereafter, we will assume that drive part 6 is a ball and that connecting element 8 is a polygonal shaped spring. It goes without saying that these examples are given purely by way of illustration and that other types of drive and connecting members could be envisaged.

Securing device 4 according to the invention is mounted as follows. Polygonal shaped spring 8 is inserted into undercut 28 in intermediate part 10. This spring, of polygonal shape, is preferably formed of a single coil, which is inscribed substantially in a circle. It is formed of a series of rectilinear segments or flats 8' arranged at an angle in relation to each other. Once spring 8 has been inserted in undercut 28 and ball 6 arranged in oblong recess 2, the assembly formed by intermediate element 10 and its spring 8 is fitted onto annular collar 16. This movement is interrupted when intermediate element 10 is stopped, via the heel 40 thereof, against the bottom of groove 20. At that moment, the two undercuts 26 and 28 are opposite each other and spring 8 can return to its rest position in the annular groove thereby formed. In this position, the top between two consecutive segments 8' of spring 8 is for example abutting against intermediate element 10, whereas the middle of each of the segments 8' that precedes and follows the top is abutting against annular collar 16. This arrangement makes back cover 1 totally inseparable from intermediate element 10 after assembly. Back cover 1 retains, however, the possibility of rotating relative to intermediate element 10.

Once back cover 1 and intermediate element 10 have been indissociably assembled to each other, this assembly is screwed onto middle part 12 via threads 36 and 38. A key is used to start to screw together the assembly formed by back cover 1 and intermediate element 10. Back cover 1 and intermediate element 10 rotate together for as long as the friction forces induced by spring 8 between the back cover 1 and the intermediate element 10 are greater than the tightening torque of the intermediate element 10 on middle part 12. Once the tightening torque becomes greater than the friction forces generated by spring, intermediate element 10 is immobilised and back cover 1 continues to rotate relative to the intermediate element 10. As it rotates, the back cover drives ball 6, which is stopped at the bottom of oblong recess 2. The rotation of back cover 1 relative to intermediate element 10 is continued until ball 6 abuts against the stop member 34 of the intermediate element 10, which projects into the bottom of circular groove 20. At that moment, back cover 1 and intermediate element 10 are again coupled in rotation and the rotation of back cover 1 imparts a tightening torque that screws intermediate element 10 completely onto middle part 12. When intermediate element 10 reaches a locking position on middle part 12, the screwing operation stops. In order to adjust the alignment of back cover 1 relative to the 12 o'clock-6 o'clock axis of the watch, the back cover has only to be rotated in the opposite direction to the direction of screwing. The back cover can be rotated through more than 360° since the sum of the diameter of ball 6 and the length of stop member 34 is less than the length of oblong recess 2. Of course, the torque to be exerted to adjust the alignment of back cover 1 has to be less than the tightening torque of intermediate element 10 on middle part 12. This torque must however be sufficiently high for the alignment of back cover 1 to be upset by hand. This torque is determined by sealing gasket 14 arranged between back cover 1 and middle part 12. It is estimated that a compression rate of sealing gasket 14 of at least 10% is necessary to achieve the desired objectives. It will be noted that the friction torque can be adjusted as desired depending upon the type of construction envisaged. In order to unscrew the assembly formed by back cover 1 and intermediate element 10, one need only continue to rotate back cover 1 in the opposite direction to the direction of screwing until ball 6 abuts against stop member 34 again. Thereafter, back cover 1 drives intermediate element 10 in rotation again, but this time in the direction of unscrewing.

Figure 11:
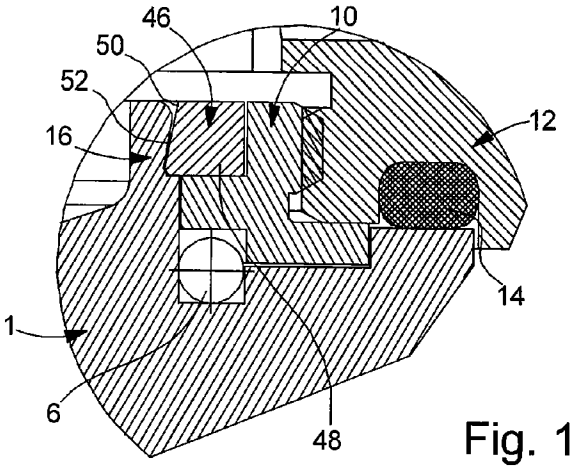
FIG. 11 is a larger scale view of the zone surrounded by a circle in FIG. 10.
Figure 9:
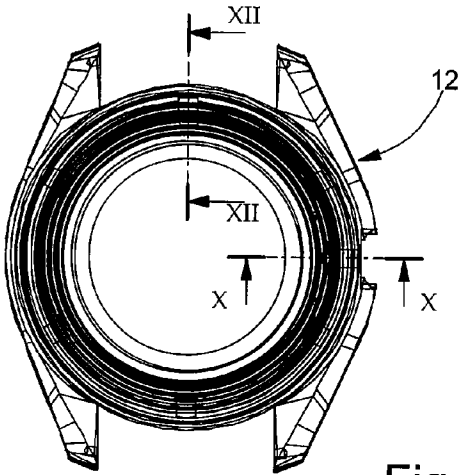
FIG. 9 is a top view of the assembly formed by the middle part and the device securing the back cover according to the invention.
Figure 10:
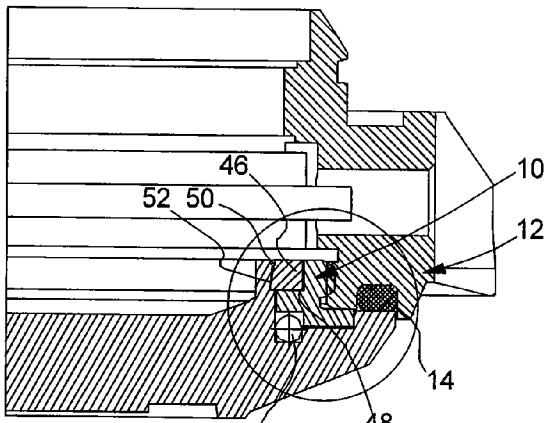
FIG. 10 is a cross-section along the line X-X of the assembly shown in FIG. 9.
Figure 12:
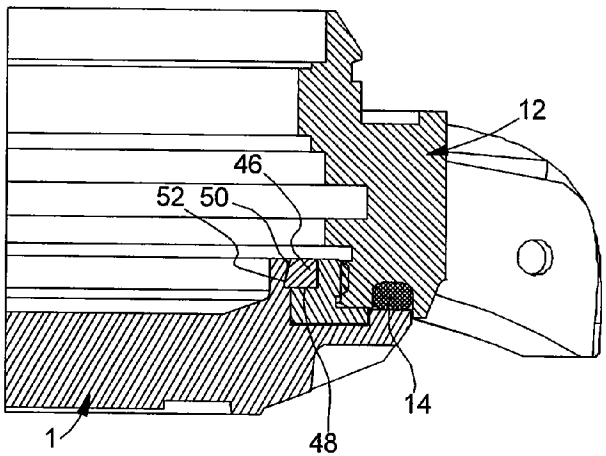
FIG. 12 is a cross-section along the line XII-XII of the assembly shown in FIG. 10.

FIGS. 10 to 12 are cross-sections of an alternative embodiment of securing device 4 according to the invention. According to this variant, connecting element 8 takes the form of a ring 46 driven between annular collar 16 of back cover 1 and intermediate element 10. More specifically, ring 46 abuts against an annular shoulder 48 arranged on the inner periphery of intermediate element 10 and on its own inner periphery has an inclined plane 50, which cooperates with a corresponding inclined plane 52 made on the external periphery of collar 16 and which enables back cover 1 to be axially coupled to intermediate element 10 via corner effect.

It goes without saying that the present invention is not limited to the embodiments that have just been described and that various simple alterations and variants could be envisaged by those skilled in the art without departing from the scope of the invention as defined by the annexed claims.

The invention claimed is:

1. A device for securing a back cover onto a middle part of a watch, the device including:

(a) an intermediate element made of a single piece to which the back cover is connected, wherein the intermediate element comprises a thread and the middle part comprises a complementary thread so that the intermediate element is screwed onto the middle part of the watch; and (b) a first element arranged in the back cover to allow the back cover to drive the intermediate element in rotation until the intermediate element reaches a locked position on the middle part, wherein the first element comprises an oblong recess that is located in the back cover and that houses a drive piece of the first element, and wherein a circular groove is formed in the back cover and the oblong recess is made in the circular groove, wherein the back cover is also pivotable relative to the intermediate element without the intermediate element being unscrewed for alignment with the 12 o'clock-6 o'clock axis of the watch.

2. The back cover securing device according to claim 1, wherein, in order to be aligned, the back cover is pivoted in the opposite direction to the direction in which the intermediate element is screwed in.

3. The back cover securing device according to claim 2, wherein the intermediate element is arranged concentrically around the back cover.

4. The back cover securing device according to claim 3, wherein the thread of the intermediate element is disposed on an external periphery thereof and the complementary thread of the middle part is disposed on an inner periphery thereof.

5. The back cover securing device according to claim 1, wherein the intermediate element is arranged concentrically around the back cover.

6. The back cover securing device according to claim 5, wherein the thread of the intermediate element is disposed on an external periphery thereof and the complementary thread of the middle part is disposed on an inner periphery thereof.

7. The back cover securing device according to claim 1, wherein the sum of the lengths of the drive piece and a stop member is less than the length of the oblong recess.

8. The back cover securing device according to claim 7, wherein the drive piece is a ball or a key.

9. The back cover securing device according to claim 1, wherein the back cover is indissociably connected to the intermediate element.

10. The back cover securing device according to claim 9, wherein a connecting element between the back cover and intermediate element is a spring element arranged between said back cover and said intermediate element.

11. The back cover securing device according to claim 10, wherein the spring element is arranged in a groove made in part in the back cover and in part in intermediate element.

12. The back cover securing device according to claim 11, wherein the spring element is a polygonal spring of generally circular shape formed of a series of segments.

13. The back cover securing device according to claim 10, wherein the spring element is a polygonal spring of generally circular shape formed of a series of segments.

14. The back cover securing device according to claim 9, wherein the connecting element between the back cover and the intermediate element is a ring driven between said back cover and said intermediate element.

15. The back cover securing device according to claim 1, wherein a connecting element between the back cover and intermediate element is a spring element arranged between said back cover and said intermediate element, and the spring element is a polygonal spring of generally circular shape formed of a series of segments.

16. The back cover securing device according to claim 1, wherein a sealing gasket is arranged between the back cover and the middle part.

17. The back cover securing device according to claim 16, wherein the compression rate of the sealing gasket is at least 10%.

18. The back cover securing device according to claim 17, wherein the torque induced by the sealing gasket is sufficient to prevent the back cover being moved out of alignment by hand but less than the tightening torque of the intermediate element on the middle part.

19. The back cover securing device according to claim 1, wherein the element arranged to allow the back cover to drive the intermediate element in rotation is a groove or a recess that is located in the back cover.

20. The back cover securing device according to claim 1, wherein the oblong recess forms an angle of between 10° and 350°.

21. A device for securing a back cover onto a middle part of a watch, the device including:

(a) an intermediate element made of a single piece to which the back cover is connected, wherein the intermediate element comprises a thread and the middle part comprises a complementary thread so that the intermediate element is screwed onto the middle part of the watch; and (b) a first element arranged in the back cover to allow the back cover to drive the intermediate element in rotation until the intermediate element reaches a locked position on the middle part, wherein the back cover is also pivotable relative to the intermediate element without the intermediate element being unscrewed for alignment with the 12 o'clock-6 o'clock axis of the watch, and wherein the first element comprises an oblong recess that is in the shape of an arc of a circle located in the back cover and the oblong recess houses a drive piece of the first element, wherein the drive piece is free to move in the oblong recess and cooperates with a stop member provided on the intermediate element for driving the intermediate element in rotation until the intermediate element reaches a locked position on the middle part.

22. The back cover securing device according to claim 21, wherein the drive piece is a ball or a key.

23. The back cover securing device according to claim 21, wherein the oblong recess is at least as long as the sum of the lengths of the drive piece and of the stop member.

24. A watch comprising:

(a) a middle part;

(b) a back cover; and (c) a device for securing the back cover onto the middle part of the watch, wherein the device includes i. an intermediate element made of a single piece to which the back cover is connected, wherein the intermediate element comprises a thread and the middle part comprises a complementary thread so that the intermediate element is screwed onto the middle part of the watch; and ii. a first element arranged in the back cover to allow the back cover to drive the intermediate element in rotation until the intermediate element reaches a locked position on the middle part, wherein the first element comprises an oblong recess that is located in the back cover and that houses a drive piece of the first element, and wherein a circular groove is formed in the back cover and the oblong recess is made in the circular groove, wherein the back cover is also pivotable relative to the intermediate element without the intermediate element being unscrewed for alignment with the 12 o'clock-6 o'clock axis of the watch.

25. A watch comprising:

(a) a middle part;

(b) a back cover; and (c) a device for securing the back cover onto the middle part of the watch, wherein the device includes i. an intermediate element made of a single piece to which the back cover is connected, wherein the intermediate element comprises a thread and the middle part comprises a complementary thread so that the intermediate element is screwed onto the middle part of the watch; and ii. a first element arranged in the back cover to allow the back cover to drive the intermediate element in rotation until the intermediate element reaches a locked position on the middle part, wherein the back cover is also pivotable relative to the intermediate element without the intermediate element being unscrewed for alignment with the 12 o'clock-6 o'clock axis of the watch, and wherein the first element comprises an oblong recess that is in the shape of an arc of a circle located in the back cover and the oblong recess houses a drive piece of the first element, wherein the drive piece is free to move in the oblong recess and cooperates with a stop member provided on the intermediate element for driving the intermediate element in rotation until the intermediate element reaches a locked position on the middle part.

26. A device for securing a back cover onto a middle part of a watch, the device including:

(a) an intermediate element made of a single piece to which the back cover is connected, wherein the intermediate element comprises i. a thread, and the middle part comprises a complementary thread so that the intermediate element is screwed onto the middle part of the watch;

ii. a circular heel; and iii. a stop member;

(b) a first element arranged in the back cover to allow the back cover to drive the intermediate element in rotation until the intermediate element reaches a locked position on the middle part, wherein the first element comprises an oblong recess that is located in the back cover and that houses a drive piece of the first element, and wherein a circular groove is formed in the back cover and the oblong recess is made in the circular groove, wherein the circular heel of the intermediate element is housed in the circular groove of the back cover, and the stop member projects into the circular groove so that rotation of the back cover relative to the intermediate element causes the drive piece to abut the stop member, and wherein the back cover is also pivotable relative to the intermediate element without the intermediate element being unscrewed for alignment with the 12 o'clock-6 o'clock axis of the watch.

27. A watch comprising a device for securing a back cover of the watch onto a middle part of the watch as recited by claim 26.

* * * * *